US006375244B1

(12) United States Patent
Smeltzer

(10) Patent No.: US 6,375,244 B1
(45) Date of Patent: Apr. 23, 2002

(54) SECURITY LOCK FOR DOOR HAVING DEADBOLT LOCK

(76) Inventor: Paul Smeltzer, 3706 Commercial St., Vancouver, British Columbia (CA), V5N 4G2

( * ) Notice: Subject to any disclaimer, the term of this patent is extended or adjusted under 35 U.S.C. 154(b) by 0 days.

(21) Appl. No.: 09/593,777

(22) Filed: Jun. 14, 2000

(51) Int. Cl.[7] ..... E05C 9/00
(52) U.S. Cl. ..... 296/36; 292/32
(58) Field of Search ..... 292/32, 33, 35, 292/36, 39, 41, 336.3, DIG. 54; 70/107, 108, 118, 120

(56) References Cited

U.S. PATENT DOCUMENTS 1,495,820 A * 5/1924 Tierney
1,671,249 A * 5/1928 Lieberman
2,166,535 A * 7/1939 Sarenholm
2,188,532 A * 1/1940 Dominguez
2,772,905 A * 12/1956 Dusing
2,787,154 A 11/1957 Wesberry
3,086,383 A * 4/1963 Scott
3,792,885 A * 2/1974 Giardina
3,991,595 A 11/1976 Bahry et al.
4,067,212 A * 1/1978 Vorob
4,088,353 A 5/1978 Meyer
4,288,944 A 9/1981 Donovan
5,524,941 A 6/1996 Fleming
6,209,364 B1 * 4/2001 Collet

* cited by examiner

*Primary Examiner*—Flemming Saether
(74) *Attorney, Agent, or Firm*—Norman M. Cameron

(57) ABSTRACT

A security lock is provided for a door having a top, a bottom, a frame and a deadbolt lock. The security lock includes a first bolt which is mountable on the door so as to extend to the top thereof to selectively engage the frame near the top of the door. There is a second bolt mountable on the door so as to extend to the bottom thereof to selectively engage the frame near the bottom of the door. There is also a mechanism which operatively connects the first bolt and the second bolt to the deadbolt lock. When the deadbolt lock is engaged, the first bolt and the second bolt engage the frame. When the deadbolt lock is disengaged, the first bolt and the second bolt are disengaged from the frame.

5 Claims, 4 Drawing Sheets

SECURITY LOCK FOR DOOR HAVING DEADBOLT LOCK

BACKGROUND OF THE INVENTION

This invention relates to security locks for doors and, in particular, security locks capable of engaging the door with a door frame on opposite sides of the frame.

Security at homes and at businesses has become an increasing concern due to high levels of break-ins and home invasions. One of the most common security measures is a deadbolt lock for exterior doors. These locks are mounted in apertures bored in the door adjacent the frame on the side opposite the hinges. The deadbolt lock includes a bolt which slidably extends from the door and engages a bore in the frame of the door, typically surrounded by a plate. While these locks do provide significantly improved security compared with knob-mounted locks, they do not provide an adequate degree of security for many doors, particularly wooden doors or steel doors with wood frames, if an intruder attempts to kick in the door. Either the door itself or the frame may fail if subjected to a hard blow from an intruder's foot.

It has been known to provide a bolt and lock for doors which includes upper and lower bolts engaging a frame or the like above and below the door. For example, a device of this nature is found in U.S. Pat. No. 2,787,154. The device in this patent is activated by a rack mechanism in conjunction with knobs.

U.S. Pat. No. 4,288,944 shows a mechanism generally similar to the patent above except that the bolts move horizontally into the frame. A similar device is shown in U.S. Pat. No. 4,088,353.

U.S. Pat. No. 5,524,941 shows a multipoint door lock assembly.

U.S. Pat. No. 3,991,595 shows a locking arrangement for doors employing sliding bolts, but it is not well adapted for retrofitting existing doors.

Bolts engageable with the top and bottom of the door, however, have not been commonly used on residential or business doors. One reason for this is that prior art devices of the general type have not been convenient to lock and unlock. They may involve the use of separate cranks or levers which may not even be accessible from the outside of the door. In addition, earlier devices are often not convenient to retrofit onto an existing standard door and deadbolt lock.

It is an object of the invention to provide an improved security lock for a door which substantially increases the level of security compared with a standard deadbolt lock.

It is also an object of the invention to provide an improved security lock for a door which engages the frame of the door adjacent opposite edges of the door and which is convenient to use.

It is a further object of the invention to provide an improved security lock for doors which engages the door to the frame adjacent the top and bottom thereof, which can be easily engaged or disengaged from both sides of the door and which is easy to install.

It is a still further object of the invention to provide an improved security lock for doors which can engage the door with the top and bottom of the frame and which does not require additional large apertures to be bored through the door apart from standard apertures for a knob and a deadbolt lock.

It is a still further object of the invention to provide an improved security lock which can be readily installed onto an existing standard door equipped with a standard deadbolt lock.

SUMMARY OF THE INVENTION

There is provided, according to one aspect of the invention, a security lock for a door having a top, a bottom, a frame and a deadbolt lock. The security lock includes a first bolt mountable on the door so as to extend to a first edge thereof to selectively engage the frame near the first edge of the door. There is a second bolt mountable on the door so as to extend to a second edge thereof and selectively engage the frame near the second edge of the door. A mechanism operatively connects the first bolt and the second bolt to the deadbolt lock. When the deadbolt lock is engaged, the first bolt and the second bolt engage the frame. When the deadbolt lock is disengaged, the first bolt and the second bolt are disengaged from the frame.

There is provided, according to another aspect of the invention, a security apparatus including a door having a top, bottom, a frame and a deadbolt lock. There is a security lock which includes a first bolt mountable on the door so as to extend to the top thereof to selectively engage the frame near the top of the door. A second bolt is mountable on the door so as to extend to the bottom thereof to selectively engage the frame near the bottom of the door. A mechanism operatively connects the first bolt and the second bolt to the deadbolt lock. When the deadbolt lock is engaged, the first bolt and the second bolt engage the frame. When the deadbolt is disengaged, the first bolt and the second bolt are disengaged from the frame.

DETAILED DESCRIPTION OF THE PREFERRED EMBODIMENTS

Figure 1:
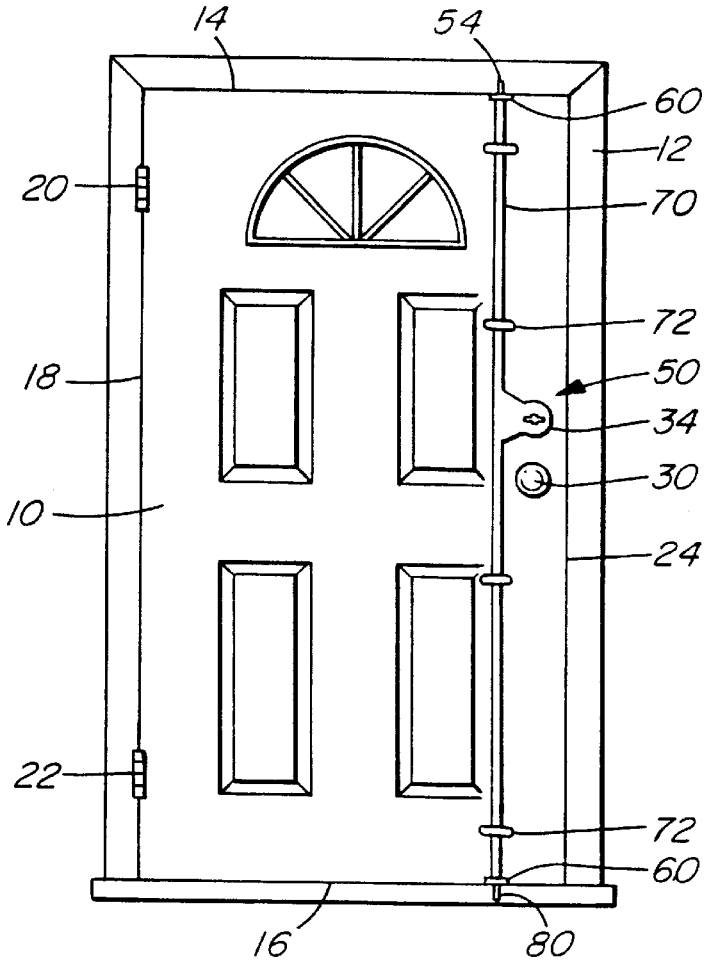
FIG. 1 is an interior, elevational view of an exterior door and frame, showing a security lock according to an embodiment of the invention.
Figure 3:
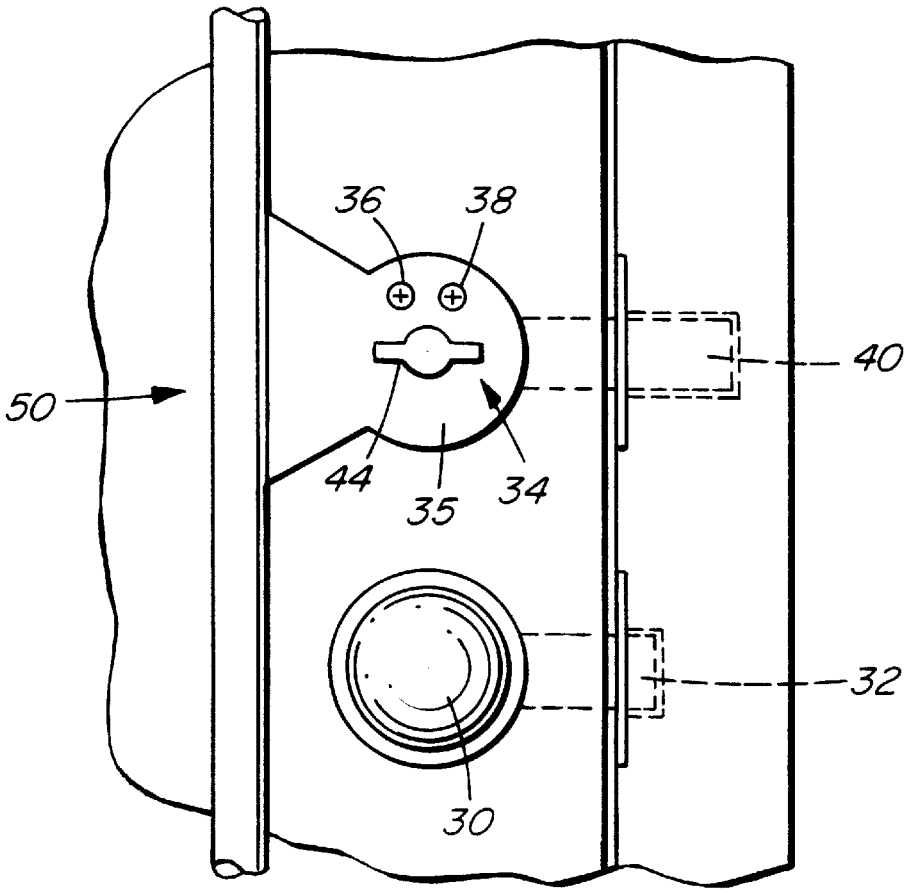
FIG. 3 is an enlarged fragmentary view showing the edge of the door opposite the hinges, a portion of the security lock and deadbolt lock and the knob for the door with associated latch.

Referring to the drawings and first to FIG. 1, this shows a door 10 of the type commonly used as an exterior door for residences. The door is fitted to a frame 12, and has a top 14, a bottom 16, an edge 18 connected to the frame with hinges 20 and 22 and an edge 24 opposite the hinges. The door is provided with a conventional knob 30 having a conventional latch 32 shown in FIG. 3. The door also is provided with a deadbolt lock 34 including a plate 35, connected to a keyed portion of the deadbolt lock (not shown) on the exterior side of the door, by screws 36 and 38. The deadbolt lock has a bolt 40 which is engaged with the frame or disengaged from the frame by rotating knob 44. The knob is connected to a keyed cylinder (not shown) on the opposite side of the door, by a rotatable bar 48 in the conventional manner. As described thus far, the door and deadbolt lock are conventional, except for plate 35 which replaces the usual circular plate.

Figure 2:
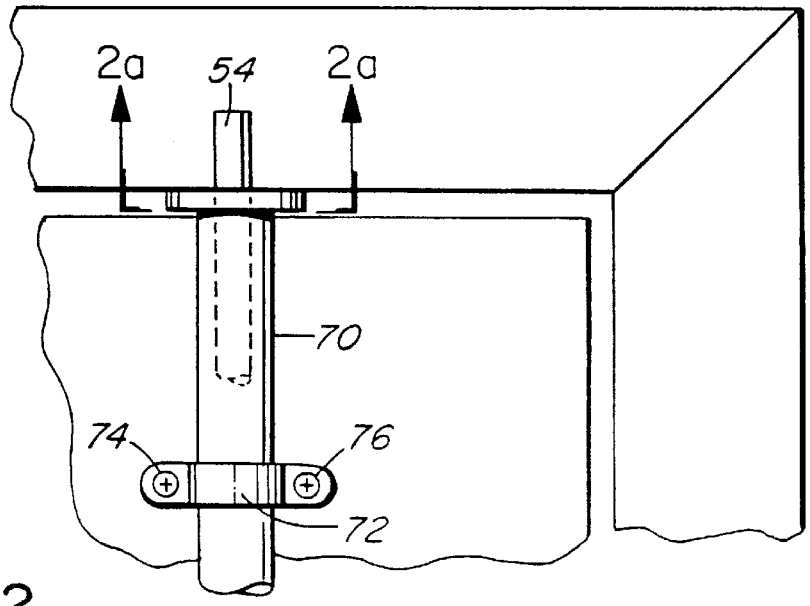
FIG. 2 is an enlarged, fragmentary view showing the top of the door, adjacent frame and a fragment of a bolt which extends to the top of the door.
Figure 2A:
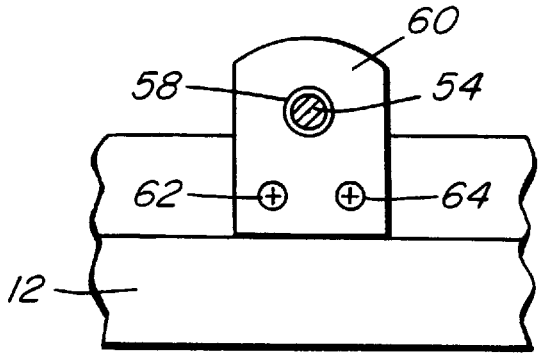
FIG. 2*a* is a sectional view taken along line 2*a*—2*a* of FIG. 2.

Door 10 however is unconventional in that it includes a security lock shown generally at 50. The lock includes a first bolt 54, shown best in FIGS. 1, 2, and 2*a*, which extends to the top of the door so as to selectively engage the frame near the top of the door. Door 10 in this example is an in-swinging door, for which the invention is primarily designed. However it may be adapted for out-swinging doors as well. When engaged, bolt 54 extends through aperture 58 and a plate 60. The plate is connected to frame 12 in this example by screws 62 and 64 as shown best in FIG. 2*a*. The bolt 54 is slidably mounted on the door for vertical movement within a tube 70 which extends from the top of the door to the bottom thereof as shown in FIG. 1. The tube is connected to the door by a plurality of straps 72, each of which as connected to the door by screws 74 and 76. One of the straps is shown in FIG. 2.

A second bolt 80 is also mounted on the door within the tube 70 and extends to the bottom of the door as shown in FIG. 1. Bolt 80 selectively engages the frame near the bottom of the door by means of a plate similar to plate 60 shown in FIG. 2*a*.

Figure 4:
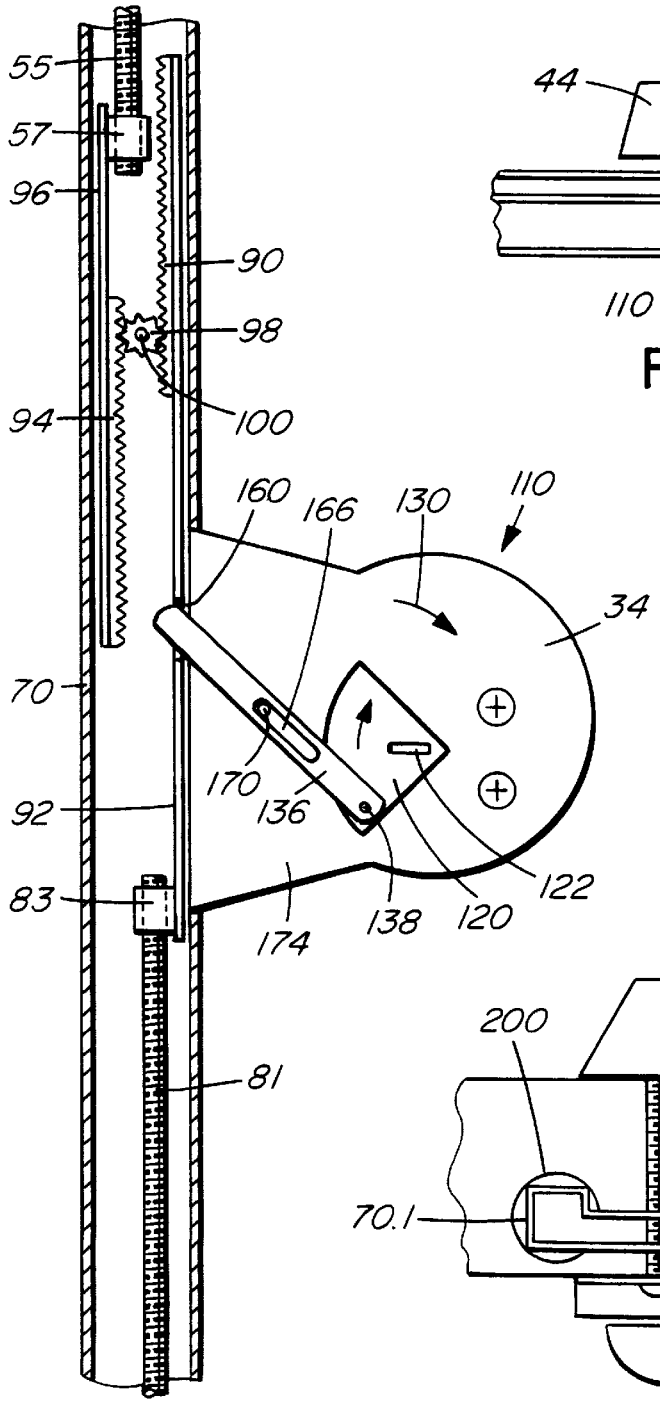
FIG. 4 is an enlarged fragmentary view, partly broken away, of the security lock and associated deadbolt lock.

As shown in FIG. 4, bolt 80 is connected to threaded rod 81. Rod 81 is connected to a gear rack 90 within tube 70 by a strap-like member 92. Similarly, bolt 54 is connected to gear rack 94 by a strap-like member 96. The threaded rods engage female threaded fittings 83 and 57. Rotation of the rods allows outward or inward adjustment of the bolts. Both gear racks engage a pinion 98 which is rotatably mounted within the tube 70 by means of a shaft 100. Thus both racks are operatively coupled to the pinion and are slidably mounted within the tube on the door such that both racks and both bolts simultaneously move towards the frame to engage the security lock and simultaneously move away from the frame to disengage the security lock. For example, when pinion 98 is rotated clockwise, from the point of view of FIG. 4, rack 90 and bolt 80 move downwardly so the bolt 80 engages the frame adjacent a first edge of the door, in this case the bottom of the door and, at the same time, rack 94 and bolt 54 moves upwardly such that bolt 54 engages the frame adjacent a second edge of the door, in this case the top of the door. When the pinion is rotated in the counter-clockwise direction, the bolts and racks move in the opposite direction away from the frame to disengage from the frame so that the door can open or close. In an alternative embodiment the security lock could operate on the sides of the door or on only one edge thereof. In the latter case there is only one rack and one bolt.

Figure 5:
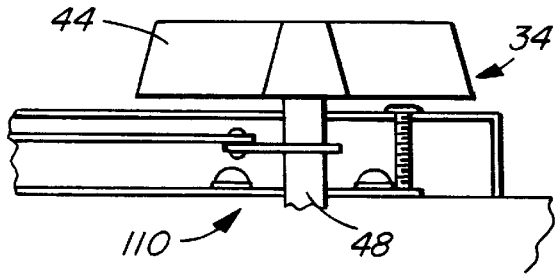
FIG. 5 is a top plan view, partly in section, of the deadbolt lock and the crank member and lever of the security lock.

There is a mechanism 110, shown best in FIGS. 4 and 5, which operatively connects the first bolt 54 and the second bolt 80 to deadbolt lock 34 whereby, when the deadbolt lock is engaged, the first bolt and the second bolt engage the frame. When the deadbolt lock is disengaged, the first bolt and the second bolt are disengaged from the frame. The mechanism includes a crank member or crank plate 120 having a slot 122. Bar 48 of the deadbolt lock is fitted through the slot 122 such that, when the knob 44, or the keyed cylinder on the opposite side of the door, is rotated, the crank member is rotated. For example, with reference to FIGS. 1, 3 and 4, knob 44 is rotated clockwise to engage deadbolt 40 with the frame. This rotates crank member 120 clockwise as indicated by arrow 130. The knob 44 is rotated counter-clockwise to disengage deadbolt 40 from the frame. This rotates crank plate 120 counter-clockwise from the point of view of FIG. 4.

There is a lever 136 pivotally connected to crank member 120 by a pin 138. The end of lever 136 opposite pin 138 extends through an aperture 160 in member 92 connected to bolt 80 and rack 90. There is a slot 166 in the lever located between its opposite ends. A pin 170 is fixedly secured to a member 174 extending between the deadbolt lock and the tube 70. The pin extends slidably and rotatably through the slot 166. Thus it may be seen, when the end of lever 136 adjacent pin 138 is moved upwardly as the crank member 120 is rotated clockwise from the point of view of FIG. 4, the end of the lever extending through aperture 160 is moved downwardly. This moves bolt 80 downwardly and bolt 154 upwardly due to the action of pinion 98 which is rotated clockwise. This causes the bolts 54 and 80 to engage the frame when the deadbolt lock is engaged.

Likewise, when the deadbolt lock is disengaged by rotating knob 44 counter-clockwise, this causes pin 138 to be pivoted downwardly, causing the end of lever 136 extending through aperture 160 to move upwardly. This causes bolt 80 to disengage from the door frame. Pinion 98 is rotated counter-clockwise and simultaneously moves rack 94 and bolt 54 downwardly to disengage bolt 54 from the frame.

Figure 6:
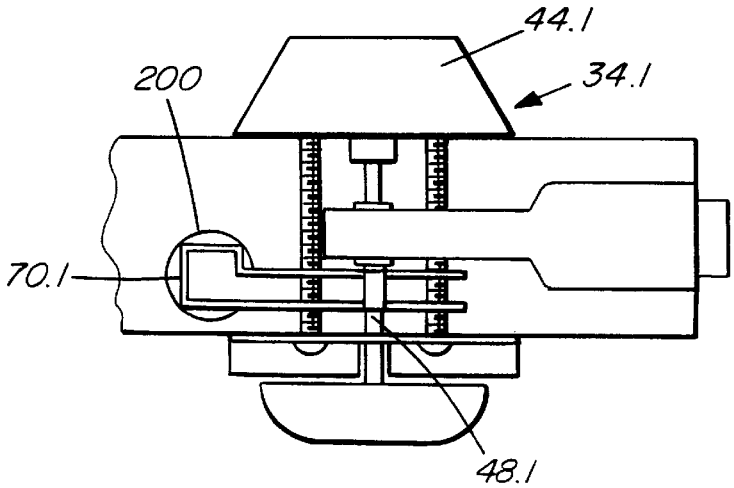
FIG. 6 is a view similar to FIG. 5 of an alternative embodiment.
Figure 7:
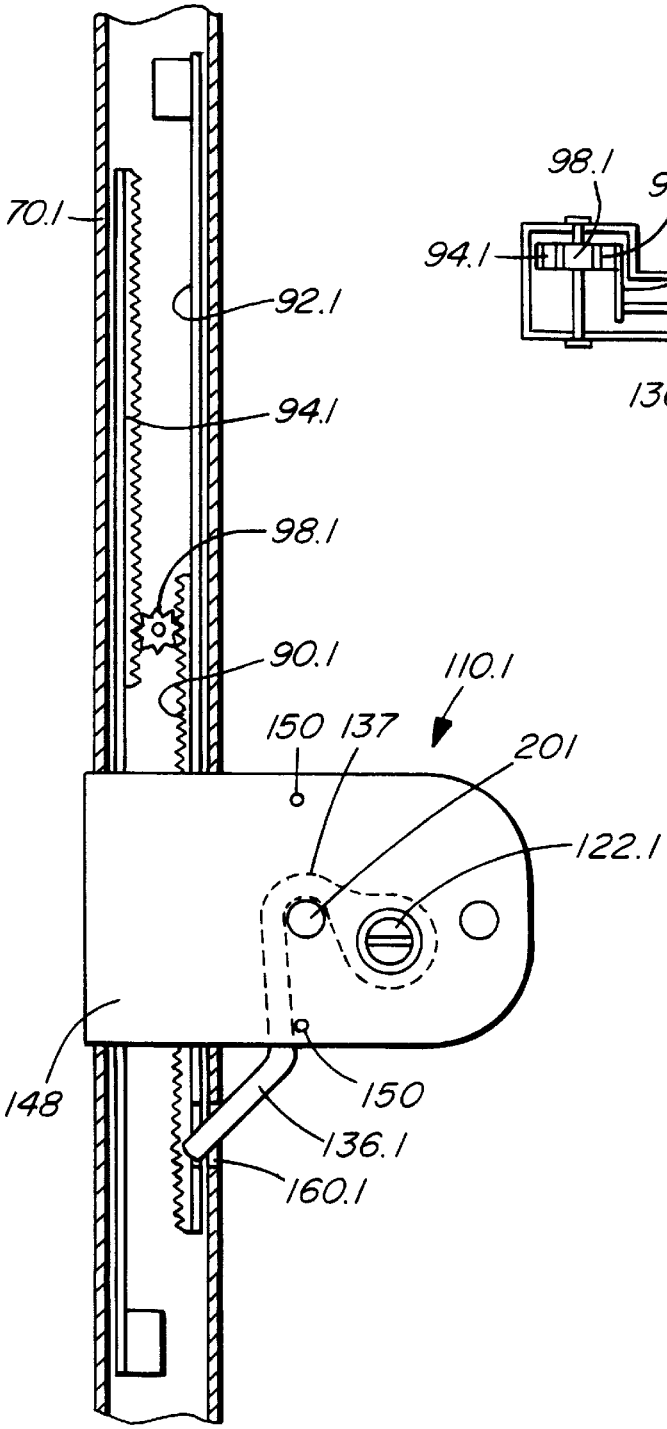
FIG. 7 is a view similar to FIG. 4 of the embodiment of FIG. 6.
Figure 8:
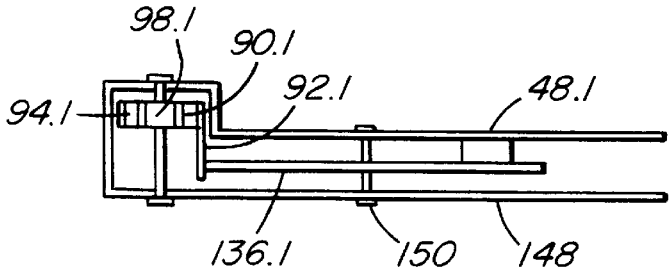
FIG. 8 is a sectional view if the embodiment of FIG. 6.

FIGS. 6 through 8 show a variation of the invention where like parts lave like numbers as in the previous example with the addition of ".1". In this example the mechanism 110.1 is modified to avoid fastening bolt 201. Lever 136.1 mounts directly on bar 48.1 by means of slot 122.1. It has a hook-like portion 137 to circumvent mounting bolt 201 of deadbolt lock 34.1. In this example aperture 160.1 is adjacent to rack 90.1 in strap 92.1 as shown in FIG. 8. This version is installed by drilling a vertical bore 200 from the top to the bottom of the door. The housing 148, held together by rivets 150, Sits through the standard hole for a deadbolt lock. The mechanism, including the rack and pinion, is then connected via the vertical bore.

It will be understood by someone skilled in the art that many of the details provided above are by way of example only and are not intended to limit the scope of the invention which is to be interpreted with reference to the following claims.

What is claimed is:

1. A security apparatus comprising:

a door having a first edge, a second edge, a frame and a dead bolt lock; and a security lock including a first bolt mountable on the door so as to extend to the first edge thereof to selectively engage the frame near the first edge of the door, a second bolt mountable on the door so as to extend to the second edge thereof to selectively engage the frame near the second edge, and a mechanism which operatively connects the first bolt to the dead bolt lock whereby, when the dead bolt lock is engaded, the first bolt engages the frame and, when the dead bolt lock is disengaged, the first bolt is disengaged from the frame, the mechanism operatively connecting the second bolt to the dead bolt lock, whereby, when the deadbolt is engaged, the second bolt engages the frame and, when the dead bolt lock is disengaged, the second bolt is disengaged from the frame, the mechanism including a lever and each of the bolts behind connected to a separate rack, both racks being operatively coupled to a pinion and being slidably mounted on the door such that both racks and both bolts simultaneously move towards the frame to engage the security lock and simultaneously move away from the frame to disengage the security lock, the lever operatively connecting the dead bolt lock to one of the racks, a cranked member being engageable with the dead bolt lock and being rotatable therewith, the lever being pivotally connected to said crank member, the lever having a first end adjacent the crank member, a second end adjacent said one rack and a slot between said one rack and the crank member, the security lock including a pin extending through the slot, whereby, when the crank member moves the first end of the lever in one direction, the second end of the lever moves the rack in a direction opposite said one direction.

2. A security apparatus as claimed in claim 1, including a tube mounted vertically on the door, the racks and the bolts being slidably mounted within the tube.

3. A security lock for a door having first and second edges, a frame and a dead bolt lock, the security lock comprising:

a first bolt mountable on the door so as to extend to the first edge thereof to selectively engage the frame near the first edge of the door;

a second bolt mountable on the door so as to extend to the second edge thereof to selectively engage the frame near the second edge, and a mechanism which operatively connects the first bolt to the dead bolt lock whereby, when the dead bolt lock is engaded, the first bolt engages the frame and, when the dead bolt lock is disengaged the first bolt is disengaged from the frame, the mechanism operatively connecting the second bolt to the dead bolt lock, whereby, when the dead bolt lock is engaged, the second bolt engages the frame and when the dead bolt lock is disengaged, the second bolt is disengaged from the flame, the mechanism including a lever, each of the bolts being connected to a separate rack, both racks being operatively coupled to a pinion and being slidably mounted on the door such that both racks and both bolts simultaneously move towards the frame to engage the security lock and simultaneously move away from the frame to disengage the security lock, the lever operatively connecting the dead bolt lock to one of the racks, a crank member engageable with the dead bolt lock and rotatable therewith, the lever being pivotally connected to said crank member, the lever having a first end adjacent the crank member, a second end adjacent said one rack and a slot between said one rack and the crank member, the security lock including a pin extending through the slot, whereby, when the crank member moves the first end of the lever in one direction, the second end of the lever moves the one rack in a direction opposite said one direction.

4. A security lock as claimed in claim 3, including a tube mountable vertically on the door, the racks and the bolts being slidably mounted within the tube.

5. A security lock for a door having first and second edges, a frame and a dead bolt lock, the security lock comprising:

a first bolt mountable on the door so as to extend to the first edge thereof to selectively engage the frame near the first edge of the door; and a mechanism which operatively connects the first bolt to the dead bolt lock whereby, when the dead bolt lock is engaged, the first bolt engages the frame and, when the dead bolt lock is disengaged, the first bolt is disengaged from the frame, the first bolt being connected to a rack, the rack being operatively coupled to a pinion and being slidably mounted on the door such that the rack and the first bolt move towards the frame to engage the security lock and move away from the frame to disengage the security lock, the lever operatively connecting the dead bolt lock to the rack, a crank member engageable with the dead bolt lock and rotatable therewith, the lever being pivotally connected to said crank member, the lever having a first end adjacent the crank member, a second end adjacent said rack and a slot between said rack and the crank member, the security lock including a pin extending through the slot, whereby, when the crank member moves the first end of the lever in one direction, the second end of the lever moves the rack in a direction opposite said one direction.

* * * * *